United States Patent [19]

Brown

[11] 4,033,468

[45] July 5, 1977

[54] HYDRAULIC BOOM-LIFT SYSTEM WITH SELECTIVE SPEEDS

[75] Inventor: Wilburn Kelly Brown, Morton Grove, Ill.

[73] Assignee: Pettibone Corporation, Chicago, Ill.

[22] Filed: July 7, 1975

[21] Appl. No.: 593,374

Related U.S. Application Data

[63] Continuation-in-part of Ser. No. 558,782, March 17, 1975.

[52] U.S. Cl. ..... 214/130 R; 91/411 R; 212/8 R; 212/59 R

[51] Int. Cl.[2] ..... B66C 23/00

[58] Field of Search ..... 214/140, 130 R, 131 R, 214/761, 762, 763, 764, 769, 770; 91/411 R, 414; 212/8 R, 35 R, 58 R, 59 R

[56] References Cited

UNITED STATES PATENTS

| | | | |
|---|---|---|---|
| 2,916,205 | 12/1959 | Litz | 91/414 |
| 3,120,823 | 2/1964 | Flowers | 91/414 |
| 3,170,379 | 2/1965 | Dempster | 91/414 |
| 3,530,767 | 9/1970 | Shook | 91/411 R |

*Primary Examiner*—L. J. Paperner
*Assistant Examiner*—Ross Weaver
*Attorney, Agent, or Firm*—Darbo, Robertson & Vandenburgh

[57] ABSTRACT

Greater overall speed of crane operation is made possible by using a plurality of hydraulic piston-cylinder sets together with valving which can direct the pumped hydraulic fluid selectively to either of the cylinder sets or to both of them. Preferably the two cylinder sets are of different speed-load characteristics so that the same supply of pressured oil will raise the boom faster when supplied to one than when supplied to the other. When the boom must be raised with maximum load, the same oil supply will be directed to both cylinder sets, thereby giving the maximum lifting power with a given available oil pressure and the slowest raising speed. The overall time required to accomplish a given task is reduced because most of the time the boom can be raised or lowered at a faster speed than that slow speed which must be provided for handling heaviest loads. Speeds are selected by operating one or both of two handles to the up or down position, each handle controlling its own valve spool. When only one handle is moved to supply fluid under pressure, the other is moved to a "float" position. Each valve spool must therefore have a float position, but for safety an interlock prevents moving both spools to the float position simultaneously.

8 Claims, 4 Drawing Figures

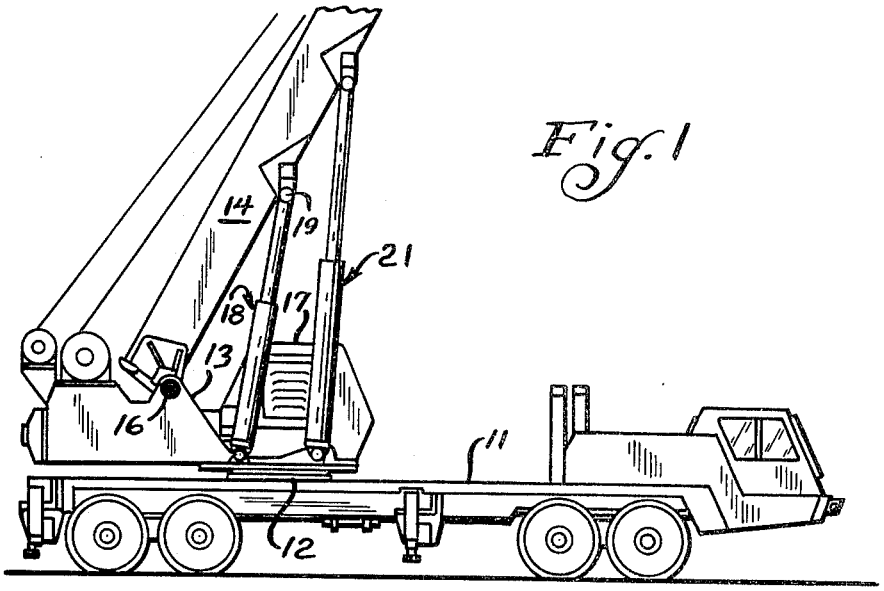
Fig. 1
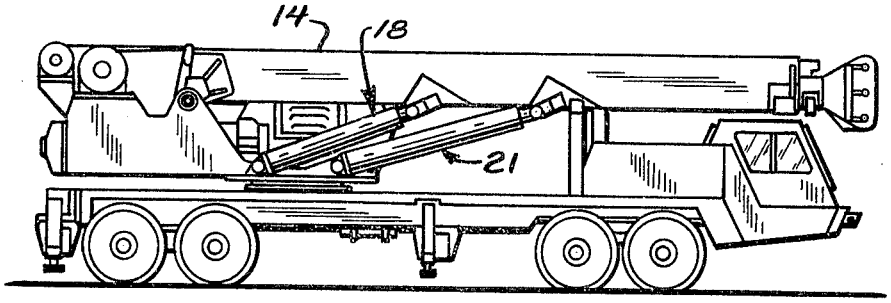
Fig. 2
Fig. 4
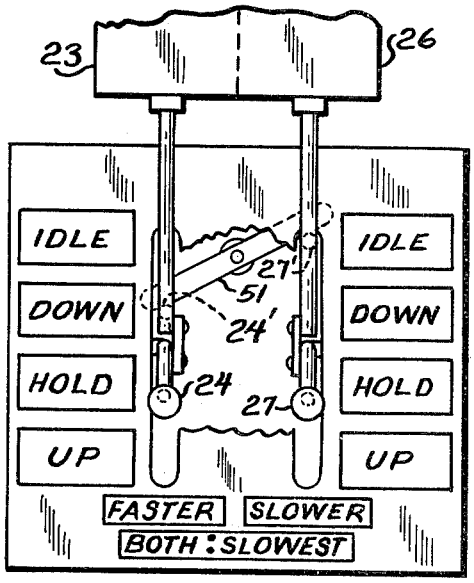
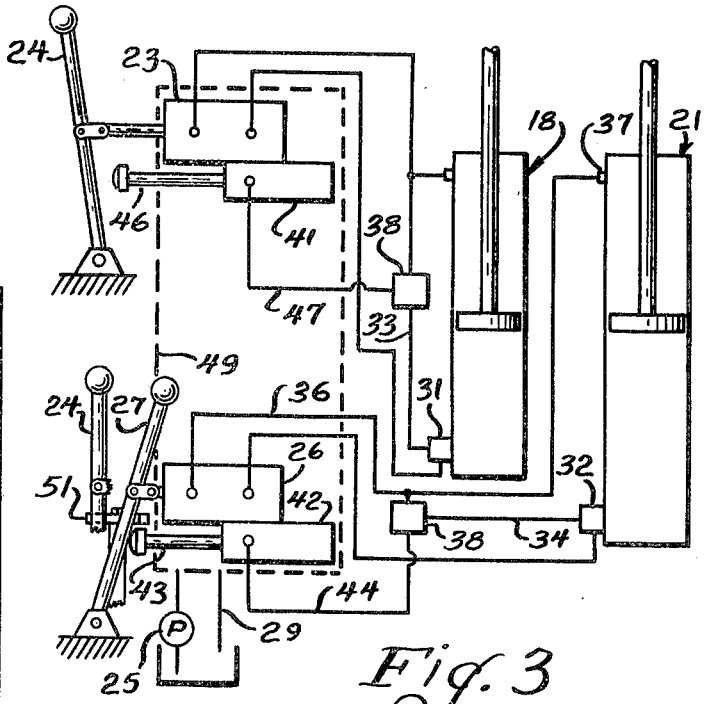
Fig. 3

HYDRAULIC BOOM-LIFT SYSTEM WITH SELECTIVE SPEEDS

INTRODUCTION

This application is a continuation in part of Ser. No. 558,782 filed Mar. 17, 1975.

The invention of which the present disclosure is offered for public dissemination in the event that adequate patent protection is available relates to hydraulic cranes, and particularly to the hydraulic raising of crane booms. Heretofore, hydraulic crane operations have usually been hampered by slow speed in the raising and lowering of the boom; a speed undesirably slow under most conditions. This undesirably slow speed tends to result from the fact that the lift cylinders must have a sufficient effective piston area so that the boom can be raised at maximum loading by the oil pressure available. From a practical standpoint, it is not usually deemed feasible to provide a type of oil supply in which there can be a greater rate of oil flow to the lift cylinders when the boom is to be raised with considerably less than maximum load. In order to achieve the high oil pressures necessary for maximum loads, pumps of the positive displacement type must be used. Pumps of this type in cranes are generally not capable of significantly varied output because in crane operation the speed at which pumps are driven tends to be relatively invariable. Although there may be some sophisticated possibilities for departing from this usual single-pumpage rate, they have not been widely accepted.

According to the present invention, the problem is solved or greatly alleviated through the use of an expedient of providing two selectively-valved cylinders or smaller diameter where one cylinder of larger diameter has been used before. Accomplishing this has required some new and special valving arrangements. Preferably three speeds are available as can be the case when the same supply of oil to one cylinder yields a faster movement than to the cylinder. When the two cylinders are both supplied by this same oil source, the slowest speed is provided with the same load capacity as if an equivalent single cylinder had been used. A separate valve handle and its associated valve spool are provided for each of the cylinders. The problem that the unused valve would cause locking of the boom by the unused cylinder is avoided by providing a "float" or "idle" position for each valve spool so that when only one cylinder is being supplied with pressure oil, the piston of the other cylinder is free to move, pushing oil of that cylinder through an idle circuit, out at one end and in at the other end. The float positions presented a safety problem which had to be solved. If both valves were moved to the float position, the boom would be permitted to fall too rapidly by gravity. Modern safety considerations will not permit this to be possible. It is here made impossible by an interlock such that when one of the spools is moved to the float position, the other cannot possibly be moved to that position and therefore provides the necessary safe control of the boom.

Another problem which had to be solved resulted from the safety valves required at the gravity-pressured port of any cylinder which can let a load fall if a hose bursts. This problem is solved by providing an auxiliary spool (which is opened as the main spool moves to its float position) to supply pilot pressure to the associated safety valve. This is the subject of my prior application Ser. No. 558,782 filed Mar. 17, 1975. The benefit of its filing date is claimed as to its subject matter.

Advantages of the invention will be more apparent from the following description and from the drawings.

DESIGNATION OF FIGURES

FIG. 1 is a side view of an embodiment of the present invention with the boom raised, part of the boom being omitted.

FIG. 2 is a corresponding view with the boom lowered.

FIG. 3 is a schematic view illustrating the hydraulic circuitry.

FIG. 4 is a view of the twin valve-control levers, their marking and their interlock, as might be used in the circuitry of FIG. 3.

BACKGROUND DESCRIPTION

Although the invention could be used in connection with any boom which swings upwardly, it has been illustrated in connection with a truck crane. Here a chassis 11 carries a turntable 12 which carries a crane base 13 on which a boom 14 is pivoted about a horizontal axis 16. Preferably an operator's cab 17 is also mounted on turntable 12. Heretofore, the boom 14 has been raised and lowered by cylinder means 18 connected to the boom about a single horizontal axis 19. The drawings only show one side of the crane. It should be understood that the cylinders shown would be matched by like cylinders on the far side, although in theory a single cylinder centered under the boom could be the cylinder means 18.

Conventionally boom 14 is raised and lowered by control of a single valve handle accessible to the operator in cab 17, for controlling the flow of oil to and from the cylinder means 18. The speed of the boom, being raised or lowered, is generally the slow speed appropriate for maximum loads.

THE SPEED-CHOICE OF THE PRESENT INVENTION

As seen in FIGS. 1 and 2, additional cylinder means 21 has been provided, approximately parallel to cylinder means 18, and slightly forwardly of it. It should be understood that although the cylinder means 18 comprises two cylinders on opposite sides of the boom 14, and the same is true of cylinder means 21, the two cylinders of each cylinder means function as one and hence no figure to show the far-side cylinders is deemed necessary. For simplicity, each cylinder means may be discussed as if it were a single cylinder.

In FIG. 3, cylinder 18 has been illustrated as of smaller diameter than cylinder 21. As a result, given flow of oil, such as the output of pump 25, into cylinder 18 will cause more rapid piston movement than the same flow of oil into cylinder 21. Thus directing oil from pump 25 to cylinder 18 only would raise the boom more rapidly than directing oil to cylinder 21 only. Even if the two cylinders were of the same diameter, some differential of speed would result from the fact that cylinder 21 is more remote from the axis 16 than is cylinder 18 so that a greater piston movement is required to achieve a given angular movement of the boom 14. There would be a practical advantage in having all of the boom-lift cylinders alike, and with careful selection this advantage can be achieved even with a desirable differential of boom-lift speed for a given oil flow.

As illustrated in FIG. 3, cylinder means 18 is controlled mainly by reversing valve 23, the spool of which is actuated by handle 24. A reversing valve will connect pump 25 to either end of the cylinder it controls, connecting the other end to discharge 29. Likewise the cylinder 21 is controlled by handle 27.

As illustrated in FIG. 4, each of the valves 23 and 26 are four-position valves. As with most such valves, these valves are spring-returned to a neutral position marked "Hold" in FIG. 4. To raise the boom either or both handles 24 and 27 can be pulled rearwardly toward the operator to the position marked "Up". To lower the boom either or both of these handles may be moved forwardly or away from the operator to the position marked "Down".

Actually, it is not enough to move one of the handles 24 and 27 to the "Up" or "Down" position while leaving the other of these handles at the "Hold" position. This is because these valves are of the neutral-closed type so that each hydraulically locks its cylinder when in the "Hold" position. It would accomplish nothing (except waste of power through a pressure relief valve, not shown) to move one of the handles 24 to an operating position while retaining the other in the "Hold" position and thus keeping its cylinder hydraulically locked.

To permit the raising of the boom by either of the cylinders 18 or 21, each of the valves 23 and 26 is provided with a fourth position marked "Idle" in FIG. 4, in which the spool provides the connections normally called "Float". In the float position, each valve opens both of its cylinder connections to each other and to the tank discharge connection 29 to allow all of its associated cylinder to flow freely out one end of the cylinder and in the other, under the influence of movement of the piston within the cylinder. Safety valve 31 and 32 are here ignored for the moment.

It follows that if handle 24 is moved to the "Up" position and handle 27 to the "Idle" position, boom 14 is raised by the oil delivered from pump 25 to cylinder 18, while cylinder 21 idles or exerts no influence. This provides the highest speed of raising of boom 14.

If handle 27 is moved to the "Up" position and handle 24 to the "Idle" position, boom 14 is raised by the full oil flow from pump 25 to cylinder 21 while cylinder 18 idles. This provides a slower raising of boom 14, but also provides more lifting power in case a heavier load is being lifted.

If both of handles 24 and 27 are moved to the "Up" position, oil from pump 25 is supplied to both of cylinders 18 and 21 and the boom 14 is raised by the joint action of both of these cylinders. However, inasmuch as the oil is still the same output supplied by the same pump 25, the raising speed will be considerably slower than with raising being accomplished only by cylinder 21 and very much slower than with raising being accomplished only by cylinder 18. However, this provides the maximum lifting force for raising the maximum load. In fact, cylinder sizes would of course be chosen by the crane designer such that with the pressure available from pump 25 the maximum design capacity could be raised. The pistons of cylinder means 18 and 21 combined might have the same area as would in the past have been provided in cylinder means 18 as the sole cylinder means.

This designing of the components to be able to lift the load at a rated capacity is of course standard practice. Heretofore, however, it has been accompanied by the disadvantage that the speed of movement determined by this method of design would be the speed of movement for all boom-raising operations. The boom-lowering operations have been slightly faster because the piston rods reduce the effective piston area on boom-lowering operations. Nevertheless, the slow speed of lowering resulting from the design for maximum loads has been applicable to all boom-lowering operations.

As already explained, however, the present invention permits two faster operations of raising and lowering boom 14. The fastest is by powering cylinder 18 alone and the slower or intermediate speed is by powering cylinder 21 alone.

Designers may in some instances choose to increase rated capacities by using slightly larger total piston area than before, knowing that by the present invention the previous disadvantage of slow speed can be avoided in most operations.

SELECTIVE OPENING OF SAFETY VALVES

Safety requirements require the use of such safety valves as 31 and 32. Such a valve controls the flow of oil outwardly through the lower or gravity-pressured port of a cylinder. These valves prevent the flow of oil out through their respective ports except when actuated or opened by a pilot pressure through their respective pilot lines 33 and 34. In the case of a normal lowering operation, for example by moving valve handle 27 to the "Down" position, pressure from pump 25 will be directed through the lowering line 36 to upper port 37 of cylinder 21. This alone would not cause the lowering of the boom because closed valve 32 would prevent the discharge of oil from below the piston of cylinder 21. However, the pressure applied to lowering line 36 is also applied (through valve 38 in FIG. 3) to pilot line 34 thereby opening valve 32 to allow the necessary outflow of oil from the lower end of cylinder 21. The speed of lowering can be delicately controlled by handle 27 because if it merely cracks open valve 26, the pressure applied to lowering line 36 will be quickly reduced by the downward movement of the piston in cylinder 21, thereby allowing safety valve 32 to reclose or partially reclose. In short, if only a slight flow of oil is permitted by valve 26, only a correspondingly slow speed of movement of boom 14 will result.

In order to achieve the "Idle" or "Float" condition for cylinder 18 or cylinder 21, it is necessary to supply a pilot pressure of oil to its pilot line 33 or 34 when its valve 23 or 26 is moved to the "Idle" position. This function is accomplished by the auxiliary valve 41, for valve 23, or 42 for valve 26. Thus as handle 27 moves from the "Down" position to the "Idle" position, it actuates plunger 43 which actuates the spool in valve 42 to supply oil to the float-pilot line 44. This pressure trips valve 38 to close its connection to line 36 so that the pressure supplied to line 44 is directed entirely to pilot line 34.

Valve 38 is a type of valve known as a shuttle valve. The characteristic of such valves is that if pressure is supplied to it by line 44, it closes its connection to line 36, and if pressure is supplied to it by line 36, it closes its connection to line 44. Without valve 38 the needed pilot pressure would not reach valve 32. When valve 42 is not actuated by its plunger 43, it is spring returned to its neutral position which connects line 44 to discharge 29. Likewise line 36 is connected to discharge 29 when valve 26 is in its idle position. Hence it is necessary to close the respective connections to either of these lines when the other line is supplied with pressure, in order for that pressure to be conveyed to pilot line 34 instead of being wasted to discharge 29.

It will be apparent that in similar manner, when handle 24 is moved to the "Idle" position, it actuates plunger 46 to actuate the spool of valve 41 to supply pressure from pump 25 to its float-pilot line 47 and through its associated shuttle valve 38 to pilot line 33 for actuating or opening pilot valve 31 so that oil can flow from beneath the piston of cylinder 18 through valve 23 to discharge 29 or to the upper end of cylinder 18. It should be understood that valves 23, 26, 41 and 42 will in practice usually be four side-by-side spools in a single valve block represented by the broken lines 49. Oil pressure from pump 25 is made available by this valve block to all of the spools but passes to discharge 29 when no spool is actuated, or when a predetermined maximum working pressure is exceeded.

It is expected that a valving system under which all of the cylinders supporting boom 14 would be effectively in the "Float" condition would be prohibited for safety reasons. That would permit the boom 14 to fall as rapidly as its pistons could discharge the oil through wide-open safety valves 31 and 32 and connecting lines. To positively prevent this unsafe occurrence, some interlock such as bar 51, seen best in FIG. 4, is preferably provided. If handle 27 is moved to the "Idle" position represented by broken lines 27', it swings the interlock lever 51 to the position shown in FIG. 4 so that the handle 24 can be moved no further toward the "Idle" position than is represented by broken lines 24'. In this position, it will not yet have actuated its plunger 46. Likewise, if handle 24 is thrust to its "Idle" position, it reverses the position of interlock bar 51 so that handle 27 can be moved no further than to the "Down" position at which it has not yet actuated its plunger 43.

For the purpose of illustration, FIG. 3 has shown valve sets 23, 41 and 26, 42 in positions such that the interlock between their handles would not be as simple as seen in FIG. 4. Nevertheless, the interlock bar 51 has been shown in conjunction with handle 27 with a phantom or partly broken away showing of handle 24 in the background as if obstructed by the interlock bar 51.

ACHIEVEMENT

From the foregoing it is apparent that the present invention can provide three speeds of boom operation with a single constant-flow supply of oil under pressure. The fastest speed results from powering only cylinder 18, a slower speed by powering cylinder 21, and the slowest speed by powering both cylinders. Operation is exceedingly simple, the operator normally operating only one valve control handle for boom raising or lowering as has been the case heretofore; the other valve handle being left in the "Idle" position. Thus when light loads are to be handled, handle 27 will be thrust to the "Idle" position and left there, and the boom will be raised and lowered by movements of handle 24. When moderately heavier loads are to be handled, handle 24 will be thrust to the "Idle" position and the boom will be raised and lowered under the control of handle 27. When loads too heavy for cylinder 21 are to be handled, which in many jobs will be only rarely, both of handles 24 and 27 will be operated simultaneously for controlling the raising and lowering of the boom 14. Preferably these handles are close enough together to be grasped by one hand and moved by that hand simultaneously, leaving the other hand free for controlling another function such as boom swing or raising or lowering the line.

In the claims, the term "oil" should be understood to include any hydraulic fluid used for powering the cylinders.

I claim:

1. A hydraulic system for raising and lowering a boom at three different speeds, when using a generally constant-speed supply of pressured oil, including an oil reservoir, a first cylinder means, a second cylinder means of different effective cross-sectional area, and valving means including a reversing valve shiftable to reverse and throttle the flow through the connections of supply and return to cylinder means by a single manual actuator, said valving means including means for supplying pressured-oil from said supply as a single source optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means.

2. A hydraulic system for raising and lowering a boom at three different speeds, when using a generally constant-speed supply of pressured-oil, including an oil reservoir, a first cylinder means, a second cylinder means of different effective cross-sectional area, and separate reversing valving means for each cylinder means including a reversing valve shiftable to reverse and throttle the flow through the connections of supply and return to cylinder means by a single manual actuator, said valving means including means for jointly supplying pressured-oil from said supply optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means.

3. A hydraulic system for raising and lowering a boom at three different speeds, when using a generally constant-speed supply of pressured-oil, including an oil reservoir, a first cylinder means, a second cylinder means of different effective cross-sectional area, and separate reversing valving means for each cylinder means including a reversing valve shiftable to reverse and throttle the flow through the connections of supply and return to cylinder means by a single manual actuator, said valving means including means for jointly supplying pressured-oil from said supply optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means;

each of the separate valving means including a reversing valve with neutral, boom-lift, boom-lower and idle positions.

4. A hydraulic system for raising and lowering a boom at three different speeds, when using a generally constant-speed supply of pressured-oil, including an oil reservoir, a first cylinder means, a second cylinder means of different effective cross-sectional area, and separate reversing valving means for each cylinder means including a reversing valve shiftable to reverse and throttle the flow through the connections of supply and return to cylinder means by a single manual actuator, said valving means including means for jointly supplying pressured-oil from said supply optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means;

each of the separate valving means including a reversing valve with neutral, boom-lift, boom-lower and idle positions, and a second valve actuated as the reversing valve is moved to idle position for supplying pilot pressure to open a cylinder safety valve.

5. A hydraulic system for raising and lowering a boom at three different speeds, when using a generally constant-speed supply of pressured-oil, including an oil reservoir, a first cylinder means, a second cylinder means of different effective cross-sectional area, and separate reversing valving means for each cylinder means including a reversing valve shiftable to reverse and throttle the flow through the connections of supply and return to cylinder means by a single manual actuator, said valving means including means for jointly supplying pressured-oil from said supply optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means;

each of the separate valving means including a reversing valve with neutral, boom-lift, boom-lower and idle positions, and a second valve actuated as the reversing valve is moved to idle position for supplying pilot pressure to open a cylinder safety valve; said system including interlock means for preventing the simultaneous supply of pilot pressure from both of said second valves.

6. A hydraulic system for raising and lowering a boom at three different speeds, when using a generally constant-speed supply of pressured-oil, including an oil reservoir, a first cylinder means, a second cylinder means of different effective cross-sectional area, and separate reversing valving means for each cylinder means including a reversing valve shiftable to reverse and throttle the flow through the connections of supply and return to cylinder means by a single manual actuator, said valving means including means for jointly supplying pressured-oil from said supply optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum lifting force available, and slowest speed when not throttled, by supplying said oil pressure to the combined piston areas of both cylinder means;

each of the separate valving means including a reversing valve with neutral, boom-lift, boom-lower and idle positions; said system including interlock means for preventing the effective simultaneous positioning of both of said valves in the idle position.

7. A hydraulic system for actuating a member at three different speeds when using a generally constant-speed supply of pressured-oil including a first cylinder means, a second cylinder means of different effective cross-sectional area, and valving means for supplying pressured-oil from said supply as a single source optionally:

a. to the first cylinder means while the second cylinder means is allowed to float, for one speed when not throttled, b. to the second cylinder means while the first cylinder means is allowed to float, for a second speed when not throttled, or c. to both cylinder means simultaneously to achieve the maximum actuation force available, and slowest speed when not throttled, by supplying said oil pressure to the combined piston areas of both cylinder means.

8. The combination of a boom and means for controllably raising and lowering the boom comprising a pair of double-acting cylinder means arranged for raising and lowering the boom, each cylinder means having a safety valve closing its "down" port, through which oil must be discharged for the boom to be lowered, except when pilot pressure is supplied to said safety valve, and a valving system comprising a pair of spool-type reversing valves each having a pair of cylinder ports connected to one of the cylinder means, one through the safety valve to the down port and the other to the opposite port, and to supply pilot pressure to the safety valve, and each reversing valve having neutral, extend, retract and idle positions, the extend and retract positions being variable for speed control, and in which only the idle position permits free flow between its cylinder ports; an auxiliary valve for each reversing valve actuated as its reversing valve moves into idle position to supply pilot pressure to the safety valve of its associated cylinder means; and interlock means for preventing the simultaneous operation of both of said auxiliary valves to supply pilot pressure to both safety valves.

* * * * *